US009939237B2

(12) United States Patent
Lutzenberger et al.

(10) Patent No.: US 9,939,237 B2
(45) Date of Patent: Apr. 10, 2018

(54) FOLDING FIN SYSTEM

(71) Applicant: MBDA Deutschland GmbH, Schrobenhausen (DE)

(72) Inventors: Joerg Lutzenberger, Augsburg (DE); Wolf-Diether Mast, Ottobrunn (DE)

(73) Assignee: MBDA Deutschland GmbH, Schrobenhausen (DE)

( * ) Notice: Subject to any disclaimer, the term of this patent is extended or adjusted under 35 U.S.C. 154(b) by 172 days.

(21) Appl. No.: 14/967,177

(22) Filed: Dec. 11, 2015

(65) Prior Publication Data

US 2016/0169643 A1 Jun. 16, 2016

(30) Foreign Application Priority Data

Dec. 11, 2014 (DE) ..... 10 2014 018 258
Apr. 9, 2015 (DE) ..... 10 2015 004 703

(51) Int. Cl.
*F42B 15/01* (2006.01)
*F42B 10/14* (2006.01)
*B64D 3/00* (2006.01)

(52) U.S. Cl.
CPC ..... *F42B 10/14* (2013.01)

(58) Field of Classification Search
CPC ..... F42B 10/14; F42B 10/16
See application file for complete search history.

(56) References Cited

U.S. PATENT DOCUMENTS 2,858,765 A * 11/1958 Startzell ..... F42B 10/16 244/3.29
4,165,847 A * 8/1979 Detalle ..... F42B 10/16 244/3.29
4,588,145 A * 5/1986 Inglis ..... F42B 10/16 244/3.23
4,673,146 A * 6/1987 Inglis ..... F42B 10/16 244/3.23
5,820,072 A * 10/1998 Na ..... F24B 10/14 244/3.27
6,092,264 A 7/2000 Banks
6,186,442 B1 * 2/2001 Bittle ..... F42B 10/16 244/3.29
6,739,548 B1 * 5/2004 Bittle ..... F42B 10/16 244/3.29
2011/0315812 A1 * 12/2011 Shin ..... F42B 10/16 244/49

FOREIGN PATENT DOCUMENTS

DE 27 28 388 A1 1/1978
EP 1 628 112 A1 2/2006

OTHER PUBLICATIONS

European Search Report issued in European counterpart application No. EP 15 00 3429 dated Apr. 5, 2016, with Statement of Relevancy (Two (2) pages).

* cited by examiner

*Primary Examiner* — Richard G Davis
(74) *Attorney, Agent, or Firm* — Crowell & Moring LLP

(57) ABSTRACT

A folding fin system includes a fin root and an upper fin part that is rotatably borne on the fin root. The upper fin part may be moved relative to the fin root between an unfolded and a folded position, and wherein the upper fin part and the fin root may be locked relative to one another using a slot-and-key system when the upper fin part is in the unfolded position.

14 Claims, 4 Drawing Sheets

FOLDING FIN SYSTEM

CROSS REFERENCE TO RELATED APPLICATIONS

This application claims priority under 35 U.S.C. § 119 from German Patent Application No. 10 2014 018 258.4, filed Dec. 11, 2014, and 10 2015 004 703.5, filed Apr. 9, 2015, the entire disclosures of which are herein expressly incorporated by reference.

BACKGROUND AND SUMMARY OF THE INVENTION

The invention relates to the folding fin system described in the following, in particular a self-locking folding fin concept that was realized with the goals of robustness, reliability, and minimizing manufacturing costs. This folding fin was attained by using the fewest possible components, production parts with a design that is optimized for function and production, and by employing standard components.

Folding fin systems are known from the prior art, for example, in EP 1 628 112 A1. Folding fin systems are always used when a guided missile requires a fin for stabilizing its flight, but at the same time must be launched from a generally cylindrical launch tube. In this case folding fin systems are used, wherein the fin is folded in so that the missile can be placed in the launch tube. As soon as the missile is launched and leaves the launch tube, the fin moves to its unfolded condition so that the missile may be guided.

In known systems, however, it is disadvantageous that the systems are extremely complex and thus expensive to produce. In addition, known systems may not be used for a number of missiles; in particular known system are not scalable or adaptable.

It is therefore an object of the invention to provide a folding fin system that may be used for a plurality of missiles, while being simpler and more cost-effective to manufacture and assemble, and that in particular may be easily scaled or adapted.

This object is attained using a folding fin system that includes a fin root and an upper fin part. The upper fin part is rotatably borne on the fin root. The upper fin part may be moved between an unfolded position and a folded position using a movement of the upper fin part relative to the fin root. The movement is in particular a rotation of the upper fin part relative to the fin root. It is inventively provided that the fin root and the upper fin part may be locked relative to one another using a key-and-slot system when the upper fin part is in the unfolded position. Locking by means of key and slot ensures that the upper fin part cannot be moved out of the unfolded position. Thus, it is assured that the folding fin system can develop its fin effect without this being interrupted by the upper fin part folding inadvertently. The fin root may be applied and attached, in particular, from outside to a missile casing, especially using attaching elements such as screws, rivets, or an adhesive bond. In addition to being characterized by robustness and reliability, as has already been verified numerous times during an ejection test, the folding fin is also characterized by the possibility of scaling and simple adaptation to other missiles, since the fins do not engage in the casing of the missile. The fin root may be produced integrally with the missile section (e.g., precision extrusion molding) or may be applied to the missile section from the outside.

It is preferably provided that the upper fin part is borne via an axis on the fin root. To this end, the fin root has a first axial mount, while the fin upper part has a second axial mount. The axis is arranged inside of the first axial mount and the second axial mount. Moreover, it is preferably provided that the first axial mount includes at least one first axial mount element and the second axis includes at least one second axial mount element. Particularly advantageously, a plurality of first axial mount elements and a plurality of second axial mount elements are present, wherein, in particular, the number of first axial mount elements is equal to the number of second axial mount elements. Advantageously, the axis is guided alternately inside the first axial mount element and the second axial mount element. This provides a connection of the upper fin part to the fin root in the manner of a hinge.

Particularly preferred, exactly one second axial mount element is allocated to each first axial mount element. The first axial mount element has a slot, while the allocated second axial mount element has a corresponding key. In an alternative embodiment, the first axial mount element has a key, while the allocated second axial mount element has a corresponding slot. Thus the aforesaid key-and-slot system is realized especially in the first axial mount and second axial mount, particularly advantageously in the first axial mount element and second axial mount element. The term "allocated" here shall especially be construed to mean that the slot or key of the first axial mount element may be caused to engage with the key or slot of the allocated second axial mount element such that the aforesaid locking is realized. In particular, it is provided that keys and slots exclusively of allocated first axial mount elements and second axial mount elements may be caused to engage with one another.

In addition, it is particularly advantageous when the key may be inserted into the slot parallel to the axis using a relative movement between upper fin part and fin root. Thus, a rotation about the axis is required for unfolding the folding fin system, i.e., for moving the upper fin part into the unfolded position, while a translation along the axis is required for locking the upper fin part to the fin root. This separation of movements ensures secure and reliable locking.

Each key and/or slot has a tapered area with conically tapering flanks and an end area with parallel flanks. It is particularly advantageous when the conically tapering flanks are chamfers in the parallel flanks. Thus, in particular, it is provided that for inserting the key into the slot, first the tapered area of the key must be inserted into the tapered area of the slot, which is facilitated by the conically tapering flanks or chamfers. As soon as the key is completely inserted into the slot, the flanks of the end areas block a relative movement between key and slot in all directions except along the insertion direction of the key into the slot. Thus, in particular, a rotation of the upper fin part about the axis is prevented.

Furthermore, it is preferably provided that borne on the axis is an elastic element that presses each first axial mount element against the allocated second axial mount element. Particularly advantageously, the elastic element is a compression spring. Particularly advantageously, the compression spring is supported against a first end of the axis and against a first axial mount element. At the same time, it is provided that a second end of the axis is supported against a second axial mount element. In this manner, the axis is continuously tensioned so that the first axial mount element and the allocated second axial mount element are always pressed against one another. Thus it is assured that the relative movement between upper fin part and fin root that is required for inserting the key into the slot is automatically performed when the upper fin part is in the unfolded position. For releasing the lock, this means for removing the key from the slot, a movement of the upper fin part relative to the fin root would have to be performed against the elastic spring effect of the elastic element, especially the compression spring. The translation required for locking preferably occurs opposing the flight direction of the folding fin system, so that inertia during acceleration and aerodynamic forces amplify the effect of the elastic element and cannot weaken.

The first axial mount element or the second axial mount element preferably has a stop that blocks a movement of the upper fin part relative to the fin root beyond the unfolded position. Thus, it is ensured that, when there is an unfolding movement of the upper fin part relative to the fin root, the upper fin part is stopped in the unfolded position so that the key can be inserted into the slot, which means the blocking or locking of the upper fin part relative to the fin root occurs.

In addition, the folding fin system preferably has an elastic rotary element, wherein a spring force of the elastic rotary element urges the upper fin part into the unfolded position. Thus an external force must act on the folding fin system, especially on the upper fin part, to retain the upper fin part in the folded position. As soon as this external force is removed, the spring force of the elastic rotary element causes the upper fin part to execute a movement relative to the fin root to be moved into the unfolded position. In particular if the aforesaid stop is present, the upper fin part is pressed against the stop by the elastic rotary element. If, in addition, the described elastic element is borne on the axis, the folding fin system is automatically locked, since the key is inserted into the slot by the elastic spring force of the elastic element.

The elastic rotary element is particularly preferably a leg spring. In addition, it is provided that the elastic rotary element has a first leg that is inserted into a bore of the upper fin part. It is also preferably provided that the elastic rotary element has a second leg that is positioned at an angle to the first leg about a pre-tensioning/biasing angle. The magnitude of the pre-tensioning/biasing angle permits, in particular, a pretension of the elastic rotary element to be set. The second leg is advantageously positioned against the fin root or is disposed in a pocket in the fin root provided for this purpose. If the elastic rotary element, especially the leg spring, is embodied symmetrically, it is also alternatively provided that the first leg is positioned against the upper fin part instead of being guided in a bore of the upper fin part.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
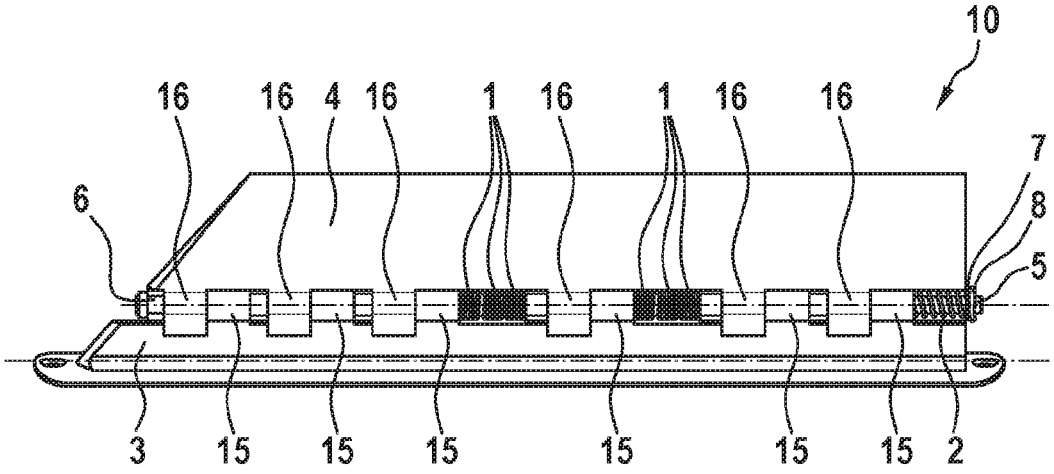
FIG. 1 is a schematic overview of the folding fin system in accordance with one exemplary embodiment of the invention.
Figure 2:
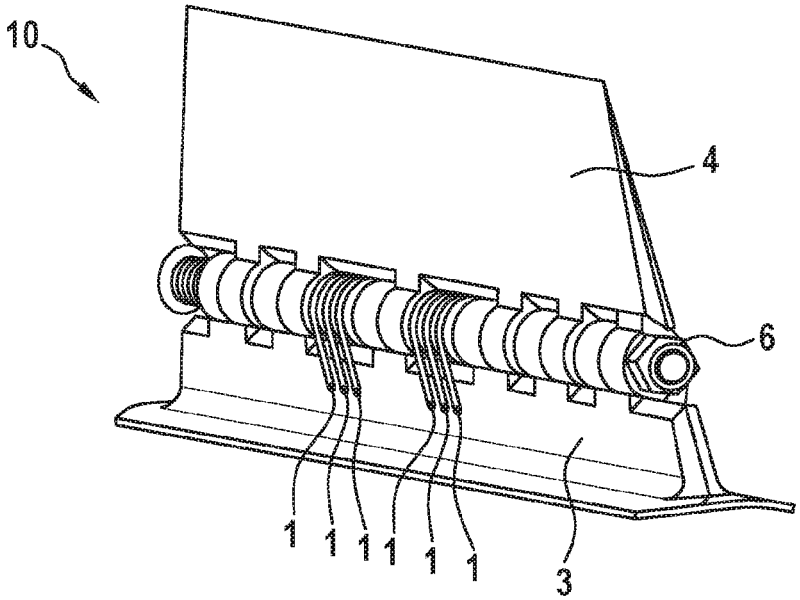
FIG. 2 is a schematic view of the folding fin system in accordance with the exemplary embodiment of the invention, in an unfolded position.

FIG. 1 is a schematic depiction of a folding fin system 10 in accordance with an exemplary embodiment of the invention. The folding fin system 10 includes an upper fin part 4, as well as a fin root 3 and an axis 5, wherein the axis 5 rotatably bears the upper fin part 4 on the fin root 3. The fin root 3 is depicted in detail in FIG. 8, while the upper fin part 4 is depicted in detail in FIG. 7.

Figure 7:
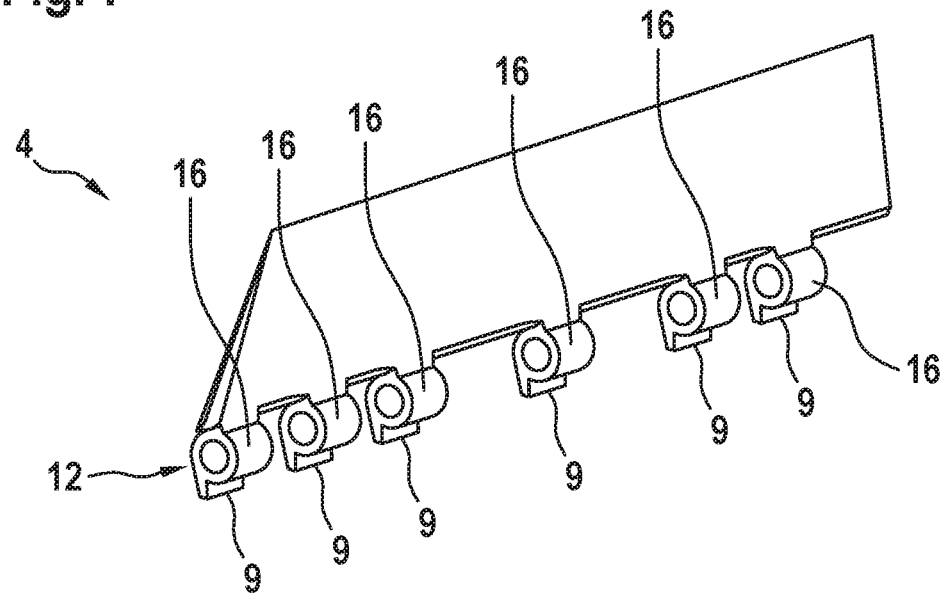
FIG. 7 is a schematic view of the upper fin part of the folding fin system in accordance with the exemplary embodiment of the invention; and, FIG. 8 is a schematic view of the fin root of the folding fin system in accordance with the exemplary embodiment of the invention.
Figure 8:
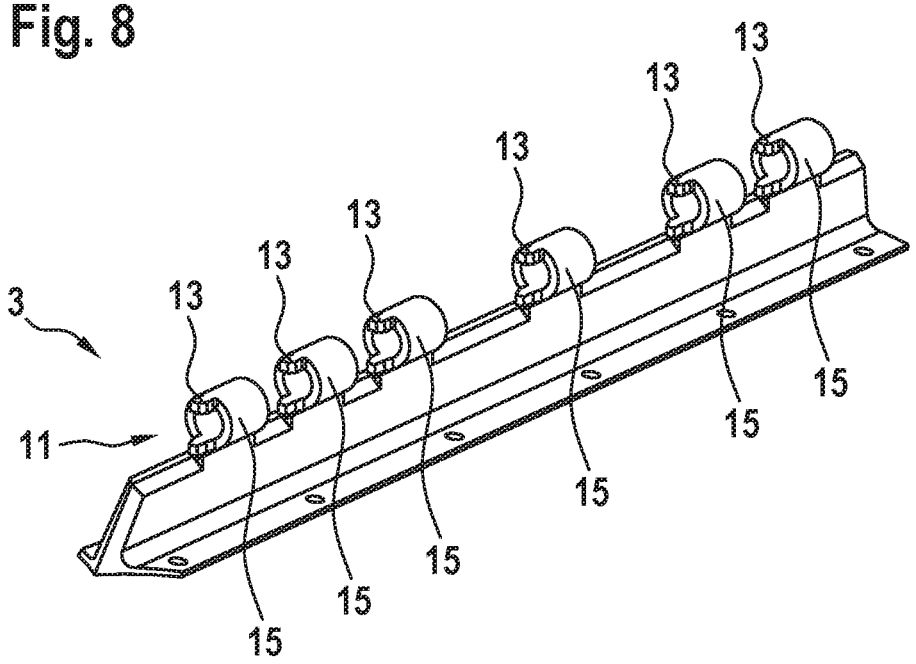

It may be seen from FIGS. 7 and 8 that the fin root 3 includes a first axial mount 11 and the upper fin part 4 includes a second axial mount 12, wherein the first axial mount 11 has a plurality of first axial mount elements 15, while the second axial mount 12 includes a plurality of second axial mount elements 16.

As may be seen from FIG. 1, the first axial mount elements 15 and the second axial mount elements 16 are arranged alternating on the axis 5, wherein one first axial mount element 15 is allocated to each second axial mount element 16.

In addition, the folding fin system 10 has a plurality of elastic rotary elements 1 or leg springs 1. Six leg springs 1 that are essentially arranged symmetrically about a center point are depicted in FIG. 1, wherein the center point divides the axis 5 into two axial parts that are essentially equal in length.

Figure 3:
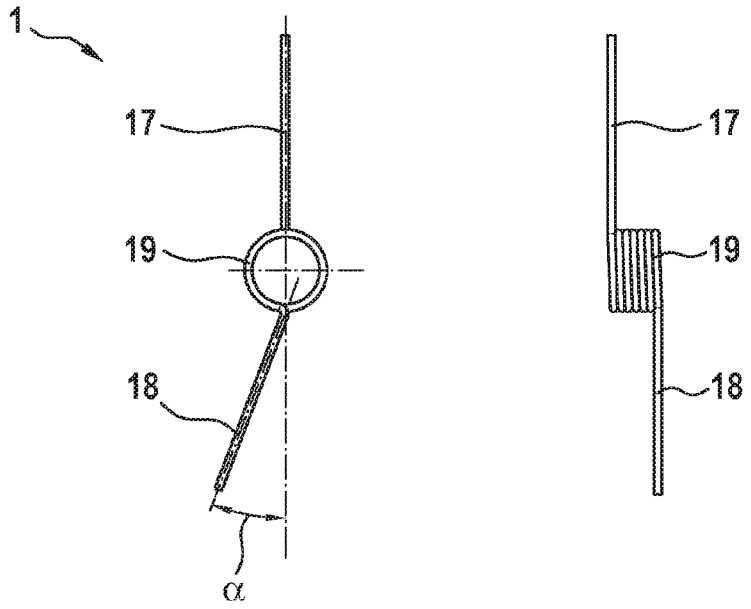
FIG. 3 is a schematic view of the elastic rotary element of the folding fin system in accordance with the exemplary embodiment of the invention.

FIG. 3 illustrates the structure of the leg springs 1. The leg springs 1 include a first leg 17, a spring body 19, and a second leg 18. The leg springs 1, whose spring bodies 19 are borne on the axis 5 with the upper fin part 4, are supported on the side of the fin root 3 via the second leg 18. This makes it possible to do without bores or pockets in the fin root 3.

The leg spring 1 is designed as illustrated in FIG. 3 so that the second leg 18 can be supported on the side of the fin root 3. Thus the second leg 18 is angled at a pre-tensioning angle $\alpha$ relative to the first leg 17. The pre-tensioning may be defined using the pre-tensioning angle $\alpha$ of the shown second leg 18.

The shown second leg 18 of the leg spring 1 may slide on the side of the fin root 3. The first leg 17 of each leg spring 1 is inserted in a bore of the upper fin part 4. If the leg springs 1 are point symmetrical or mirror symmetrical, there is no need for the bores in the upper fin part 4. Furthermore, borne on the axis 5 is an elastic element 2 or a compression spring 2 that pushes the axis 5, including upper fin part 4, backward using the nut 6 and thus presses together the hinge element formed by the upper fin part 4 and fin root 3. On the other side, the compression spring 2 is supported on the axis 5 via the flat washer 7 on the retaining ring 8.

The folding fin system 10 is constructed like a hinge. The leg spring 1 causes the rotational opening of the upper in part 4, the compression spring 2 causes a translational movement of the upper fin part 4 relative to the fin root 3 for locking the end position, i.e., the unfolded position.

Figure 4:
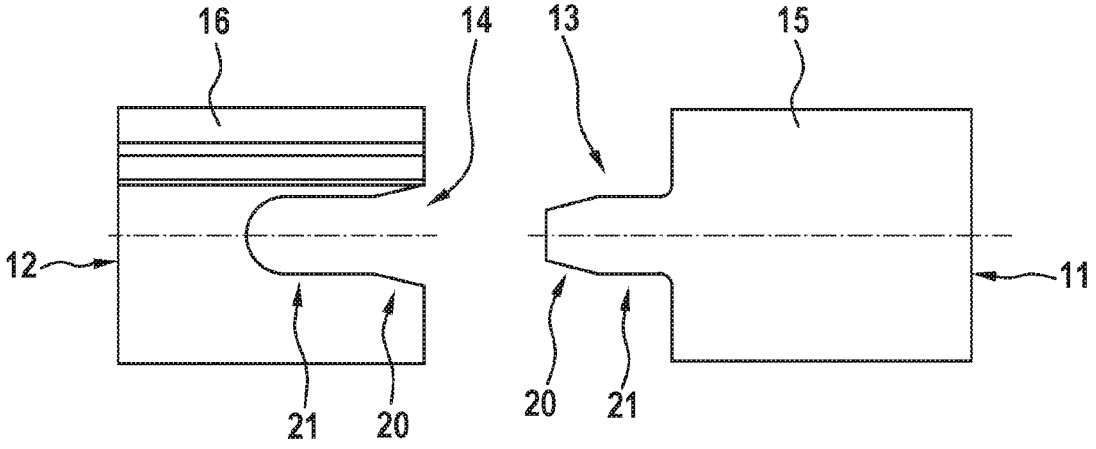
FIG. 4 is a schematic view of the key-and-slot system of the folding fin system in accordance with the exemplary embodiment of the invention.
Figure 5:
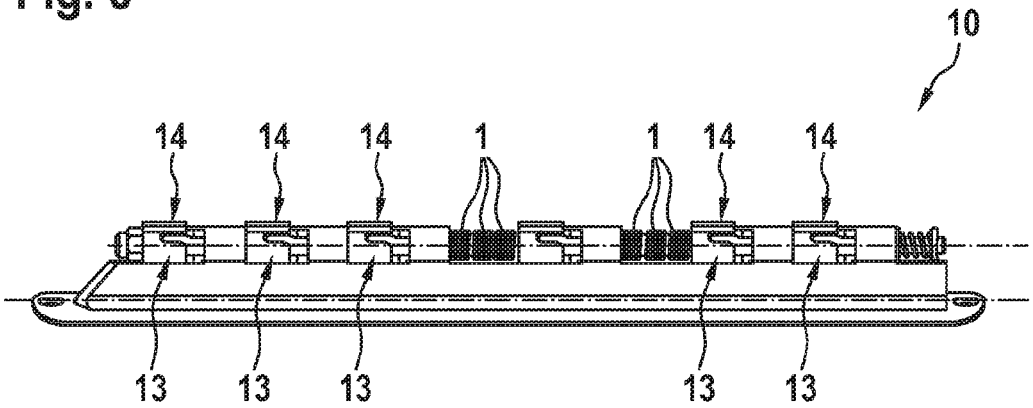
FIG. 5 is a first schematic view of the folding fin system in accordance with the exemplary embodiment of the invention, in a folded position.

To arrest the upper fin part 4 on the fin root 3, the folding fin system 10 has a key-and-slot system 13, 14. The latter is illustrated in FIG. 4 and FIG. 5. FIG. 4 illustrates a first axial mount element 15 and a second axial mount element 16, while FIG. 5 illustrates the entire folding fin system 10 in accordance with the exemplary embodiment in an unfolded position.

As may be seen especially from FIG. 4, in the exemplary embodiment the first axial mount element 15 has a spring 13, while the second axial mount element 16 has a slot 14. In accordance with the invention, the arrangement of the slot 14 and key 13 may be switched.

The key 13 and the slot 14 each have a tapered area 20 and an end area 21. The tapered area 20 is characterized by conically tapering flanks, while the flanks in the end area 21 run parallel, at least in sections. If no parallel course at all is used, a significantly stronger spring must be used for translation, since otherwise the upper fin part 4 will re-close via the conical flanks. If the flanks are not parallel, the load transfer that is assured with parallel flanks by a positive fit must be realized using a non-positive fit that must be attained using the higher pre-tension in the direction of translation. This is expressed in an increase in the frictional force on the support surfaces of the axial mount elements 15, 16 and thus also requires higher pre-tension of the elastic rotary elements 1 for the rotational movement. The positive fit is therefore preferable. To introduce the key 13 into the slot 14, first the tapered area 20 of the key 13 must be inserted into the tapered area 20 of the slot 14. This is simplified due to the conically tapering flanks. Then the key 13 may be completely inserted into the slot 14, wherein the end areas 21 overlap, at least in sections. It is provided that the end areas 21 effect a positive fit so that all relative movements between a first axial mount element 15 and second axial mount element 16, with the exception of movements along the direction of insertion of the key 13 into the slot 14 are blocked. In particular, a rotation of the upper fin part 4 about the axis 5 is also prevented in this manner so that the upper fin part 4 locks in the unfolded position and thus is fixed. The tapered areas 20 are in particular formed such that the parallel flanks of the end area 21 have chamfers. Thus the tapered area of 20 of the key 13 and of the slot 14 are very simple to produce.

The upper fin part 4 is then locked on the fin root 3 as follows: Due to the chamfers inside the tapered areas 20 of key 13 and slot 14, the key 13 is threaded into the slot 14 in a simplified manner. A straight, parallel course of the slot flanks adjoins the chamfer of the slot 14, and the appropriately designed key 13 engages in a positive fit in the end position in the aforesaid course.

As soon as the keys 13 and slots 14 of the first axial mount elements 15 and second axial mount elements 16 are aligned flush, the latter slide into one another due to the spring force of the compression spring 2 and lock the upper fin part 4. FIG. 5 illustrates the position of the folded folding fin system 10 and the keys 13 and slots 14 of the first axial mount elements 15 and second axial mount elements 16.

Figure 6:
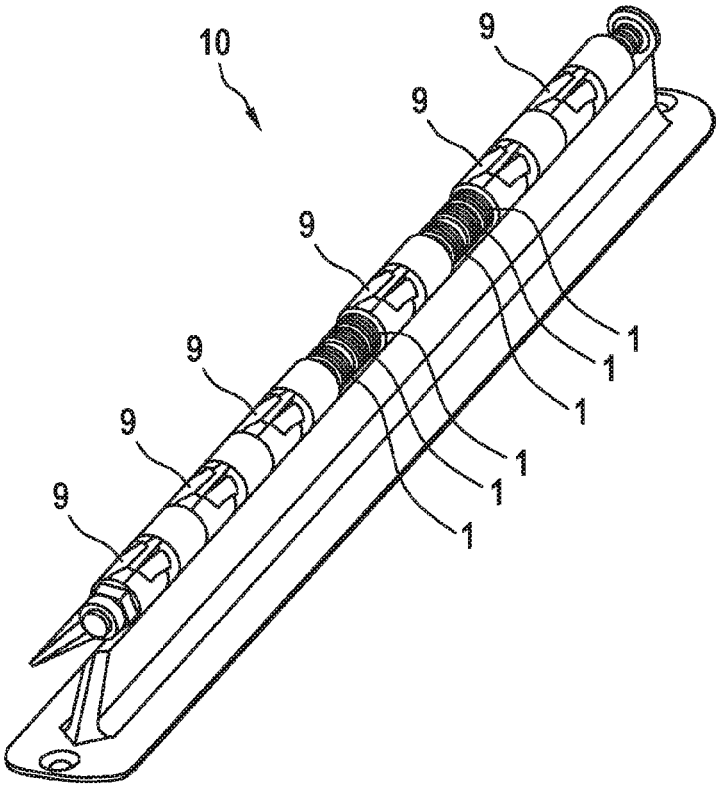
FIG. 6 is a second schematic view of the folding fin system in accordance with the exemplary embodiment of the invention, in a folded position.

On the side opposing the direction of folding, the first axial mount elements 15 of the upper fin part 4 have stops 9, as is depicted in FIG. 6. The latter stop the rotation of the upper fin part 4 in the end position, i.e., in the unfolded position that results from the upward lifting effect of the torque of the leg springs 1. Thus the keys 13 and slots 14 are also retained in the flush aligned position so that the locking is simple and reliable.

It may be seen that the folding fin system 10 is constructed in a very simple and thus cost-effective manner. In addition, the folding fin system 10 is easily scalable and thus may be adapted for different guided missiles.

Another advantage of the folding fin system 10 is that it does not engage in the casing of the guided missile, so that a very simple and cost-effective assembly of the folding fin system 10 on the guided missile is made possible.

In addition to the foregoing disclosure, explicit reference is hereby made, for additional disclosure of the invention, to the depictions in FIGS. 1 through 8.

REFERENCE LIST

1 Elastic rotary element (leg spring)
2 Elastic element (compression spring)
3 Fin root
4 Upper fin part
5 Axis
6 Nut
7 Flat washer
8 Retaining ring
9 Stop
10 Folding fin system
11 First axial mount
12 Second axial mount
13 Key
14 Slot
15 First axial mount element
16 Second axial mount element
17 First leg
18 Second leg
19 Spring body
20 Tapered area
21 End area
$\alpha$ Pre-tensioning angle The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Folding fin system, comprising:

a fin root; and an upper fin part that is rotatably borne via an axis on the fin root, wherein the fin root has a first axial mount having at least one first axial mount element and the upper fin part has a second axial mount having at least one second axial mount element, and wherein the axis is arranged within the first axial mount and the second axial mount, wherein the upper fin part is moveable relative to the fin root between an unfolded and a folded position, wherein the upper fin part and the fin root is lockable relative to one another using a key-and-slot system when the upper fin part is in the unfolded position, and wherein one of the at least one second axial mount element is allocated to each of the at least one first axial mount element, wherein the system is configured such that (i) each of said at least one first axial mount element has a slot and the allocated second axial mount element has a key corresponding to the slot, wherein at least one of the slot and the key has a tapered area with conically tapering flanks and an end area with flanks that run parallel, at least in sections, or (ii) each of said at least one first axial mount element has the key and the allocated second axial mount element has the slot corresponding to the key, wherein at least one of the slot and the key has a tapered area with conically tapering flanks and an end area with flanks that run parallel, at least in sections.

2. The folding fin system in accordance with claim 1, wherein the key is insertable into the slot parallel to the axis using a relative movement between upper fin part and fin root.

3. The folding fin system in accordance with claim 1, wherein the conically tapering flanks are chamfers in the flanks that are parallel at least in sections.

4. The folding fin system in accordance with claim 2, wherein the conically tapering flanks are chamfers in the flanks that are parallel at least in sections.

5. The folding fin system in accordance claim 1, wherein an elastic element that presses each of the at least one first axial mount element against the allocated second axial mount element is borne on the axis.

6. The folding fin system in accordance claim 2, wherein an elastic element that presses each of the at least one first axial mount element against the allocated second axial mount element is borne on the axis.

7. The folding fin system in accordance claim 3, wherein an elastic element that presses each of the at least one first axial mount element against the allocated second axial mount element is borne on the axis.

8. The folding fin system in accordance with claim 1, wherein one of the at least one first axial mount element and the at least one second axial mount element has a stop that blocks a movement of the upper fin part relative to the fin root beyond the unfolded position.

9. The folding fin system in accordance with claim 2, wherein one of the at least one first axial mount element and the at least one second axial mount element has a stop that blocks a movement of the upper fin part relative to the fin root beyond the unfolded position.

10. The folding fin system in accordance with claim 3, wherein one of the at least one first axial mount element and the at least one second axial mount element has a stop that blocks a movement of the upper fin part relative to the fin root beyond the unfolded position.

11. The folding fin system in accordance with claim 5, wherein one of the at least one first axial mount element and the at least one second axial mount element has a stop that blocks a movement of the upper fin part relative to the fin root beyond the unfolded position.

12. The folding fin system in accordance claim 1, further comprising an elastic rotary element, wherein a spring force of the elastic rotary element urges the upper fin part into the unfolded position.

13. The folding fin system in accordance with claim 12, wherein the elastic rotary element has a first leg that is guided in a bore of the upper fin part.

14. The folding fin system in accordance with claim 13, wherein the elastic rotary element has a second leg that is positioned at an angle to the first leg about a pre-tensioning angle, wherein the second leg is positioned against the fin root.

* * * * *